US008039771B2

(12) United States Patent
Trondsen

(10) Patent No.: US 8,039,771 B2
(45) Date of Patent: Oct. 18, 2011

(54) VACUUM ENVELOPE INCLUDING SELF-ALIGNING END SHIELD, VACUUM INTERRUPTER, VACUUM CIRCUIT INTERRUPTER AND METHOD INCLUDING THE SAME

(75) Inventor: William J. Trondsen, Horseheads, NY (US)

(73) Assignee: Eaton Corporation, Cleveland, OH (US)

( * ) Notice: Subject to any disclaimer, the term of this patent is extended or adjusted under 35 U.S.C. 154(b) by 616 days.

(21) Appl. No.: 12/189,320

(22) Filed: Aug. 11, 2008

(65) Prior Publication Data

US 2010/0032412 A1 Feb. 11, 2010

(51) Int. Cl.
*H01H 33/66* (2006.01)

(52) U.S. Cl. ..... 218/136; 218/10; 218/118

(58) Field of Classification Search ..... 218/118, 218/134–139, 10, 140, 147
See application file for complete search history.

(56) References Cited

U.S. PATENT DOCUMENTS

| | | | | |
|---|---|---|---|---|
| 4,547,638 | A * | 10/1985 | Kashimoto et al. | 218/136 |
| 4,937,405 | A | 6/1990 | Pilsinger et al. | |
| 5,222,651 | A * | 6/1993 | Pilsinger et al. | 228/122.1 |
| 6,417,473 | B1 | 7/2002 | Mayo et al. | |
| 6,930,270 | B2 | 8/2005 | Fieberg et al. | |
| 7,781,694 | B2 * | 8/2010 | Stoving | 218/136 |
| 2004/0074874 | A1 | 4/2004 | Fieberg et al. | |
| 2007/0007250 | A1 | 1/2007 | Li | |

FOREIGN PATENT DOCUMENTS

| | | | |
|---|---|---|---|
| DE | 3628174 | A1 | 2/1988 |
| DE | 3719256 | A1 | 12/1988 |
| DE | 19753031 | C1 | 4/1999 |
| GB | 2 308 498 | A | 6/1997 |
| GB | 2 341 979 | A | 3/2000 |
| WO | WO 03/056592 | A1 | 7/2003 |

* cited by examiner

*Primary Examiner* — Renee S Luebke
*Assistant Examiner* — Marina Fishman
(74) *Attorney, Agent, or Firm* — Martin J. Moran

(57) ABSTRACT

A vacuum envelope is for a fixed contact mounted on a fixed electrode and a moveable contact mounted on a moveable electrode. The vacuum envelope includes a ceramic tube including a first open end and a second open end. A first end member is secured to the first open end. A second end member includes an inside surface and is secured to the second open end. A self-aligning end shield includes a first end having an opening therein, a second open end, an intermediate portion disposed between the first end and the end shield second open end, and a flange portion disposed from the end shield second open end. The flange portion extends outwardly from the intermediate portion and generally back toward the first end. The flange portion includes an edge engaging the inside surface of the second end member, and is normally offset from the ceramic tube.

22 Claims, 6 Drawing Sheets

FIG. 4
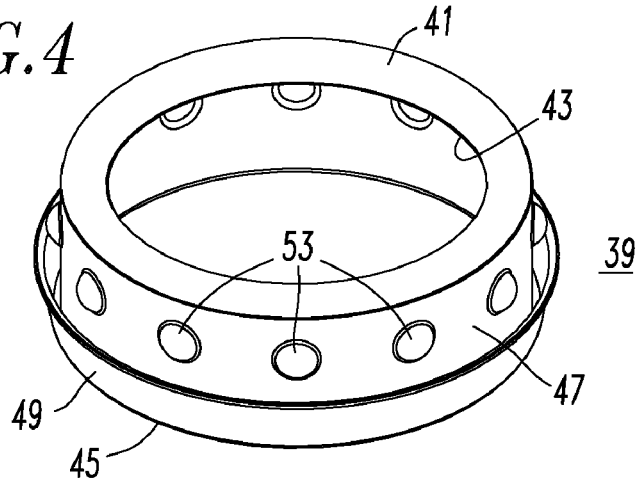
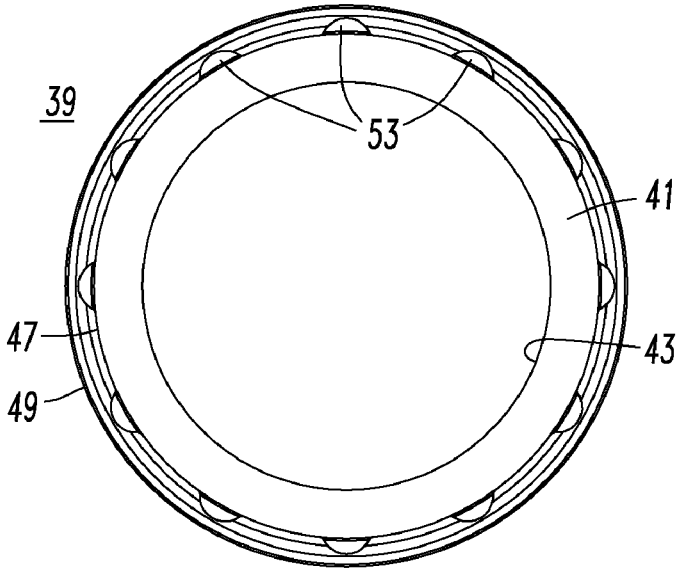
FIG. 5
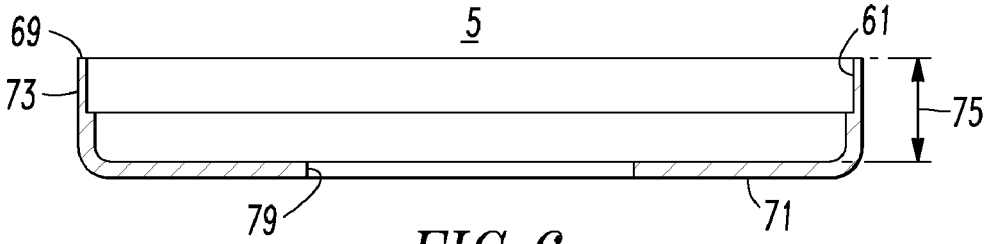
FIG. 6

VACUUM ENVELOPE INCLUDING SELF-ALIGNING END SHIELD, VACUUM INTERRUPTER, VACUUM CIRCUIT INTERRUPTER AND METHOD INCLUDING THE SAME

BACKGROUND OF THE INVENTION

1. Field of the Invention

This invention pertains generally to vacuum interrupters which provide protection in electric power circuits and, more particularly, to vacuum interrupters or vacuum envelopes including end shields that provide a self-alignment function. The invention also pertains to a self-alignment method for ends shields of vacuum interrupters. The invention further pertains to vacuum circuit interrupters including vacuum interrupters having end shields that provide a self-alignment function.

2. Background Information

Vacuum circuit interrupters (e.g., without limitation, vacuum circuit breakers; vacuum switches; load break switches) provide protection for electrical systems from electrical fault conditions such as current overloads, short circuits, and low level voltage conditions. Typically, vacuum circuit interrupters include a spring-powered or other suitable operating mechanism, which opens electrical contacts inside a number of vacuum interrupters to interrupt the current flowing through the conductors in an electrical system in response to abnormal conditions.

Vacuum interrupters include separable main contacts disposed within an insulated and hermetically sealed vacuum chamber. The vacuum chamber typically includes a number of sections of ceramics (e.g., a number of tubular ceramic portions) for electrical insulation capped by a number of end members (e.g., metal components, such as metal end plates; end caps; seal cups) to form an envelope in which a vacuum may be drawn. The ceramic section is typically cylindrical; however, other suitable cross-sectional shapes may be used. Two end members are typically employed. Where there are multiple ceramic sections, an internal center shield is disposed between the ceramic sections.

The main contacts are electrically connected to the external circuit to be protected by the vacuum circuit interrupter by electrode stems, typically an elongated member made from high purity copper. A contact and a stem are identified collectively as an electrode. Generally, one of the contacts is fixed relative to the vacuum chamber as well as to the external circuit. The fixed contact is mounted in the vacuum envelope on a first electrode extending through one end member. The other contact is movable relative to the vacuum envelope. The moveable contact is mounted on a moveable electrode axially slideable through the other end member. The movable contact is driven by the operating mechanism and the motion of the operating mechanism is transferred inside the vacuum envelope by a coupling that includes a sealed metallic bellows. The fixed and moveable contacts form a pair of separable contacts which are opened and closed by movement of the moveable electrode in response to the operating mechanism located outside of the vacuum envelope. The electrodes, end members, bellows, ceramic shell(s), and the internal center shield, if any, are joined together to form a vacuum interrupter capable of maintaining a vacuum at a suitable level for an extended period of time.

When the separable contacts are opened with current flowing through the vacuum interrupter, a metal-vapor arc is struck between the contact surfaces. This arc continues until the current is interrupted, typically as the alternating current goes through a zero crossing. In order to prevent the metal vapor from condensing on the ceramic insulator, several metal vapor shields are typically provided within the vacuum envelope. For example, the metal vapor shields can be between the contacts and the ceramic inside the vacuum envelope, and at one or both ends of the envelope.

During the manufacturing of sub-assemblies, it is known to use an external alignment flange to align the seal cup and end shield. In addition, during the manufacturing of tube assemblies, external self-aligning ceramic fixtures are used to align the seal cup to the ceramic. These, however, can slow furnace run times, reduce productivity, stick to the sub-assembly and/or shield radiant heat from braze joints causing various components to be decoupled.

In the event that the end shield is not properly secured in the vacuum interrupter, then electrical shorts can result.

There is room for improvement in vacuum envelopes and vacuum interrupters employing end shields.

There is also room for improvement in vacuum circuit interrupters, which employ vacuum interrupters including end shields.

There is further room for improvements in methods of aligning end shields of vacuum envelopes and vacuum interrupters.

SUMMARY OF THE INVENTION

These needs and others are met by embodiments of the invention, which provide a vacuum envelope including an end shield comprising a first end having an opening therein, a second open end, an intermediate portion disposed between the first end and the second open end, and a flange portion disposed from the second open end. The flange portion extends outwardly from the intermediate portion and generally back toward the first end. The flange portion includes an edge engaging an inside surface of an end member and is normally offset from an insulative tube of the vacuum envelope.

In accordance with one aspect of the invention, a vacuum interrupter comprises: a ceramic tube including a first open end and a second open end; a first end member secured to the first open end of the ceramic tube; a second end member including an inside surface, the second end member secured to the second open end of the ceramic tube, the first and second end members cooperating with the ceramic tube to form a vacuum envelope; an end shield comprising: a first end having an opening therein, a second open end, an intermediate portion disposed between the first end and the second open end of the end shield, and a flange portion disposed from the second open end of the end shield, the flange portion extending outwardly from the intermediate portion and generally back toward the first end, the flange portion including an edge engaging the inside surface of the second end member, the flange portion being normally offset from the ceramic tube; a fixed contact mounted on a fixed electrode extending through the second end member and extending through the opening of the first end of the end shield; and a moveable contact mounted on a moveable electrode extending through the first end member and axially reciprocating into and out of contact with the fixed contact.

The intermediate portion and the flange portion of the end shield may form a generally V-shaped structure at the second open end of the end shield; the generally V-shaped structure may include a free circular edge forming the edge of the flange portion and an end; the inside surface of the second end member may include a cylindrical surface and an end surface normal to the cylindrical surface; the free circular edge of the generally V-shaped structure may engage the cylindrical surface; the end of the generally V-shaped structure may engage the end surface; and the generally V-shaped structure may be structured to self-align the end shield within the second end member.

A braze ring may be disposed at the end surface of the second end member and proximate the end of the generally V-shaped structure; and the end of the generally V-shaped structure may be brazed to the end surface of the second end member.

The end of the generally V-shaped structure may not be secured to the end surface of the second end member; and the end shield may be captured between the end surface of the second end member and the second open end of the ceramic tube.

The second end member may further include a first end having an opening therein, a second open end, and a cylindrical portion disposed between the first end of the second end member and the second open end of the second end member; the cylindrical portion may form the inside surface; the fixed electrode may extend through the opening of the first end of the second end member; and the second open end of the second end member may be secured to the second open end of the ceramic tube.

A braze washer may be disposed between the second open end of the second end member and the second open end of the ceramic tube; and the second open end of the second end member may be brazed to the second open end of the ceramic tube.

Only the intermediate portion of the end shield may engage the ceramic tube.

The intermediate portion of the end shield may be a generally cylindrical portion including a plurality of dimples which engage the ceramic tube. Only the dimples of the end shield may engage the ceramic tube.

The second end member may further include a first end, a second open end secured to the second open end of the ceramic tube, and a cylindrical portion disposed between the first end of the second end member and the second open end of the second end member; the cylindrical portion may have a first height; and the flange portion of the end shield may have a second height, which is smaller than the first height, in order that the edge of the flange portion is normally offset from where the second open end of the second end member is secured to the second open end of the ceramic tube.

As another aspect of the invention, a vacuum envelope is for a fixed contact mounted on a fixed electrode and a moveable contact mounted on a moveable electrode. The vacuum envelope comprises: an insulative tube including a first open end and a second open end; a first end member secured to the first open end of the insulative tube; a second end member including an inside surface, the second end member secured to the second open end of the insulative tube; and an end shield comprising: a first end having an opening therein, a second open end, an intermediate portion disposed between the first end and the second open end of the end shield, and a flange portion disposed from the second open end of the end shield, the flange portion extending outwardly from the intermediate portion and generally back toward the first end, the flange portion including an edge engaging the inside surface of the second end member, the flange portion being normally offset from the insulative tube.

As another aspect of the invention, a method of self-aligning an end shield of a vacuum interrupter comprises: employing a ceramic tube including a first open end and a second open end; securing a first end member to the first open end of the ceramic tube; securing a second end member to the second open end of the ceramic tube; forming a vacuum envelope with the first and second end members; employing an end shield comprising a first end having an opening therein, a second open end, and an intermediate portion disposed between the first end and the second open end of the end shield; disposing a flange portion including an edge from the second open end of the end shield; extending the flange portion outwardly from the intermediate portion and generally back toward the first end; engaging the edge with the inside surface of the second end member; and offsetting the flange portion from the ceramic tube.

As another aspect of the invention, a vacuum circuit interrupter comprises: a vacuum interrupter comprising: a ceramic tube including a first open end and a second open end, a first end member secured to the first open end of the ceramic tube, a second end member including an inside surface, the second end member secured to the second open end of the ceramic tube, the first and second end members cooperating with the ceramic tube to form a vacuum envelope, an end shield comprising: a first end having an opening therein, a second open end, an intermediate portion disposed between the first end and the second open end of the end shield, and a flange portion disposed from the second open end of the end shield, the flange portion extending outwardly from the intermediate portion and generally back toward the first end, the flange portion including an edge engaging the inside surface of the second end member, the flange portion being normally offset from the ceramic tube, a fixed contact mounted on a fixed electrode extending through the second end member and extending through the opening of the first end of the end shield, and a moveable contact mounted on a moveable electrode extending through the first end member and axially reciprocating into and out of contact with the fixed contact; and an operating mechanism structured to axially reciprocate the moveable electrode and move the moveable contact into and out of contact with the fixed contact.

The intermediate portion of the end shield may be a generally cylindrical portion including a plurality of dimples which engage the ceramic tube; and only the dimples of the end shield may engage the ceramic tube.

BRIEF DESCRIPTION OF THE DRAWINGS

A full understanding of the invention can be gained from the following description of the preferred embodiments when read in conjunction with the accompanying drawings in which:

FIG. 4 is an isometric view of the end shield of FIG. 1.

FIG. 5 is a plan view of the end shield of FIG. 1.

FIG. 6 is a sectional view of the end member of FIG. 1.

DESCRIPTION OF THE PREFERRED EMBODIMENTS

As employed herein, the term "number" shall mean one or an integer greater than one (i.e., a plurality).

Figure 1:
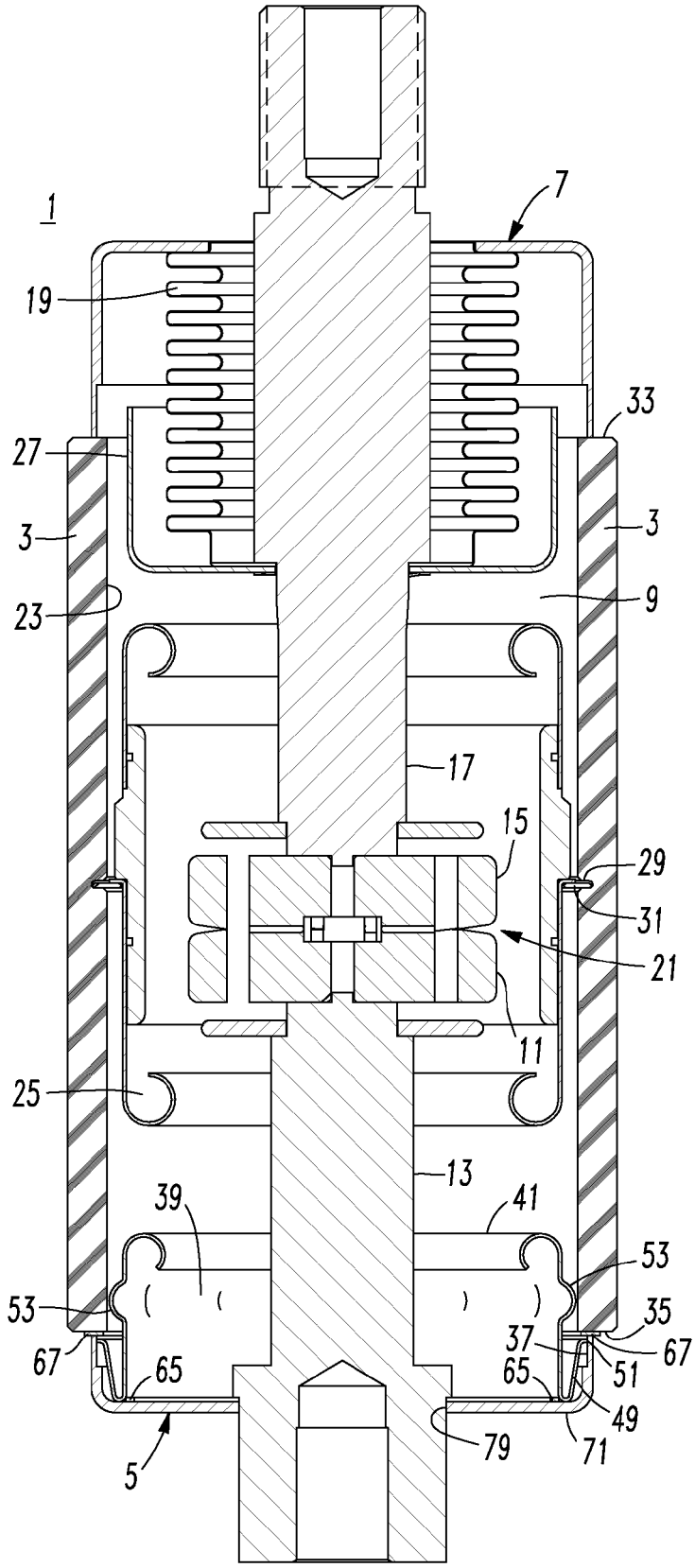
FIG. 1 is a longitudinal sectional view through a vacuum interrupter in accordance with embodiments of the invention.
Figure 7:
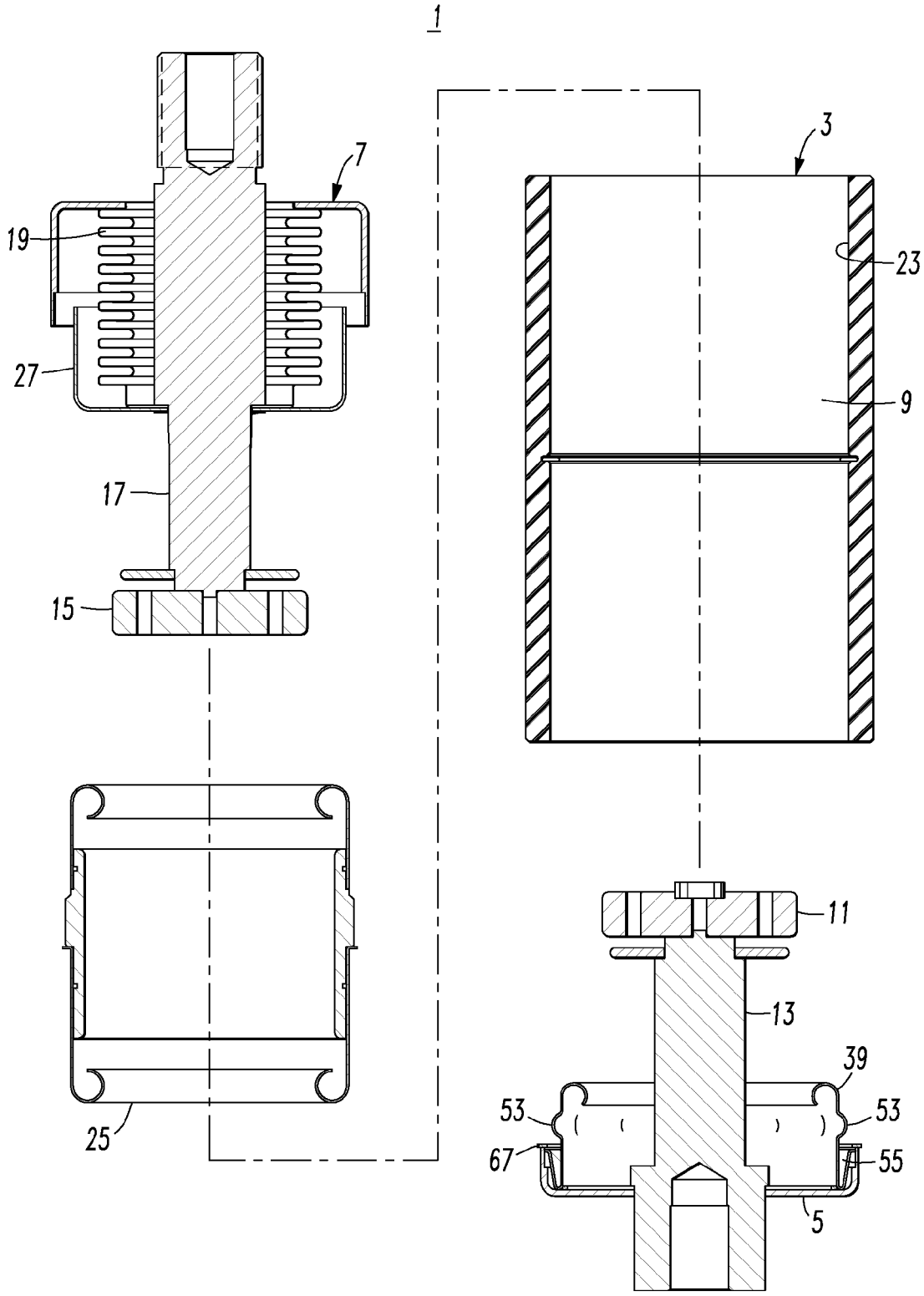
FIG. 7 is an exploded isometric view of the vacuum interrupter of FIG. 1.
Figure 8:
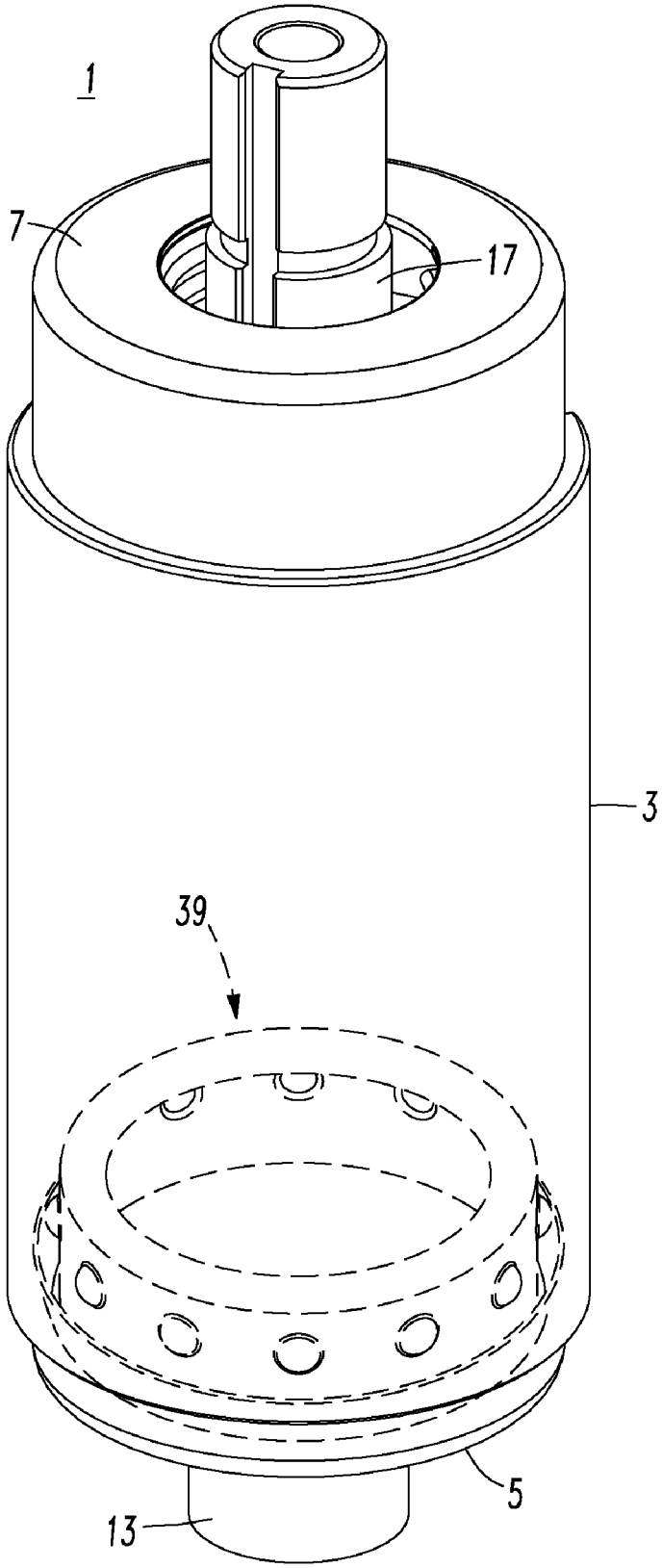
FIG. 8 is an isometric view of the vacuum interrupter of FIG. 1.

Referring to FIGS. 1, 7 and 8, a vacuum interrupter 1 is shown. The vacuum interrupter 1 includes an insulative tube, such as the example ceramic tube 3, which with end members 5 and 7 forms a vacuum envelope 9. A fixed contact 11 is mounted on a fixed electrode 13, which extends through the end member 5. A moveable contact 15 is carried by a moveable electrode 17 and extends through the end member 7. A bellows 19 forms a seal between the end member 7 and the moveable electrode 17 while allowing axial movement of the moveable electrode 17 to bring the moveable contact 15 into and out of contact with the fixed contact 11. The fixed contact 11 and moveable contact 15 form separable contacts 21, which when closed, complete an electrical circuit between the fixed electrode 13 and the moveable electrode 17, and when opened by axial movement of the moveable electrode 17 interrupt current flowing through the vacuum interrupter 1. The moveable electrode 17 is moved axially to open and close the separable contacts 21 by an operating mechanism 22 (FIG. 2) connected to the moveable electrode 17 outside of the vacuum envelope 9.

When the separable contacts 21 are opened with current flowing through the vacuum interrupter 1, an arc is struck between the fixed contact 11 and the moveable contact 15. These contacts 11,15 are configured to aid in extinguishing the arc, which is necessary to interrupt the current flowing through the vacuum interrupter 1, as is well known. The arc vaporizes metal from the contacts 11 and 15, which could be deposited on the inner surface 23 of the ceramic tube 3 that serves as an electrical insulator, as well as defining the vacuum envelope 9. In order to prevent such deposits, it is well known to provide a tubular vapor shield 25 between the separable contacts 21 and the ceramic tube 3. This tubular vapor shield 25 is generally cylindrical and can be necked down to a degree at each end to extend its protection of the inner surface 23 of the ceramic tube 3. It is common to also provide a bellows shield 27 mounted on the moveable electrode 17 to protect the bellows 19 from metal-vapor deposits.

The vapor shield 25 is a floating shield. That is, it is not electrically connected to either electrode 13,17 so that its potential floats. To provide this electrical isolation, the vapor shield 25 is supported by the ceramic tube 3 which, as mentioned, is an electrical insulator. The ceramic tube 3 has a groove 29 in the center thereof. A snap ring 31 is popped into that groove 29. The shield 25 is then lowered into the ceramic tube 3 and brazed onto the snap ring 31.

Although a one-piece ceramic tube 3 is shown, the invention is applicable to vacuum interrupters including a plurality of ceramic tubes (e.g., without limitation, an upper ceramic and a lower ceramic, with a center shield flange sandwiched therebetween).

The example ceramic tube 3 includes a first open end 33 and a second open end 35. The end member 7 is suitably secured (e.g., brazed) to the first open end 33 of the ceramic tube 3. The other end member 5 (e.g., without limitation, a seal cup) includes an inside surface 37 and is suitably secured (e.g., brazed) to the second open end 35 of the ceramic tube 3. The end members 5,7 cooperate with the ceramic tube 3 to form the vacuum envelope 9. As shown in FIGS. 1-5, an end shield 39 includes a first end 41 having an opening 43 therein, a second open end 45, an intermediate portion 47 disposed between the first end 41 and the second open end 45, and a flange portion 49 disposed from the second open end 45. The flange portion 49 extends outwardly from the intermediate portion 47 and generally back toward the first end 41. In the example embodiment, the flange portion 49 extends outwardly from the intermediate portion 47 at an angle of about 10 degrees, although the flange portion 49 may be generally parallel to the intermediate portion 47 or may be disposed any suitable angle of less than 90 degrees, as long as the edge 51 of the flange portion 49 engages the inside surface 37 of the second end member 5.

The example flange portion 49 includes the edge 51 engaging the inside surface 37 of the second end member 5. The flange portion 49 is normally offset from the ceramic tube 3. The fixed contact 11 is mounted on the fixed electrode 13 and extends through the second end member 5 and through the opening 43 of the first end 41 of the end shield 39. The moveable contact 15 is mounted on the moveable electrode 17 and extends through the first end member 7 and axially reciprocates into and out of contact with the fixed contact 11.

The vacuum envelope 9 is for the fixed contact 11 and the moveable contact 15. The vacuum envelope 9 includes, for example, the ceramic tube 3, the end members 5,7, and the end shield 39.

A method of self-aligning the end shield 39 includes employing the ceramic tube 3 including the first open end 33 and the second open end 35; securing the first end member 7 to the first open end 33 of the ceramic tube 3; securing the second end member 5 to the second open end 35 of the ceramic tube 3; forming the vacuum envelope 9 with the first and second end members 5,7; employing the end shield 39 including the first end 41 having the opening 43 therein, the second open end 45, and the intermediate portion 47 disposed between the first end 41 and the second open end 45; disposing the flange portion 49 including the edge 51 from the second open end 45; extending the flange portion 49 outwardly from the intermediate portion 47 and generally back toward the first end 41; engaging the edge 51 with the inside surface 37 of the second end member 5; and offsetting the flange portion 49 from the ceramic tube 3.

Figure 2:
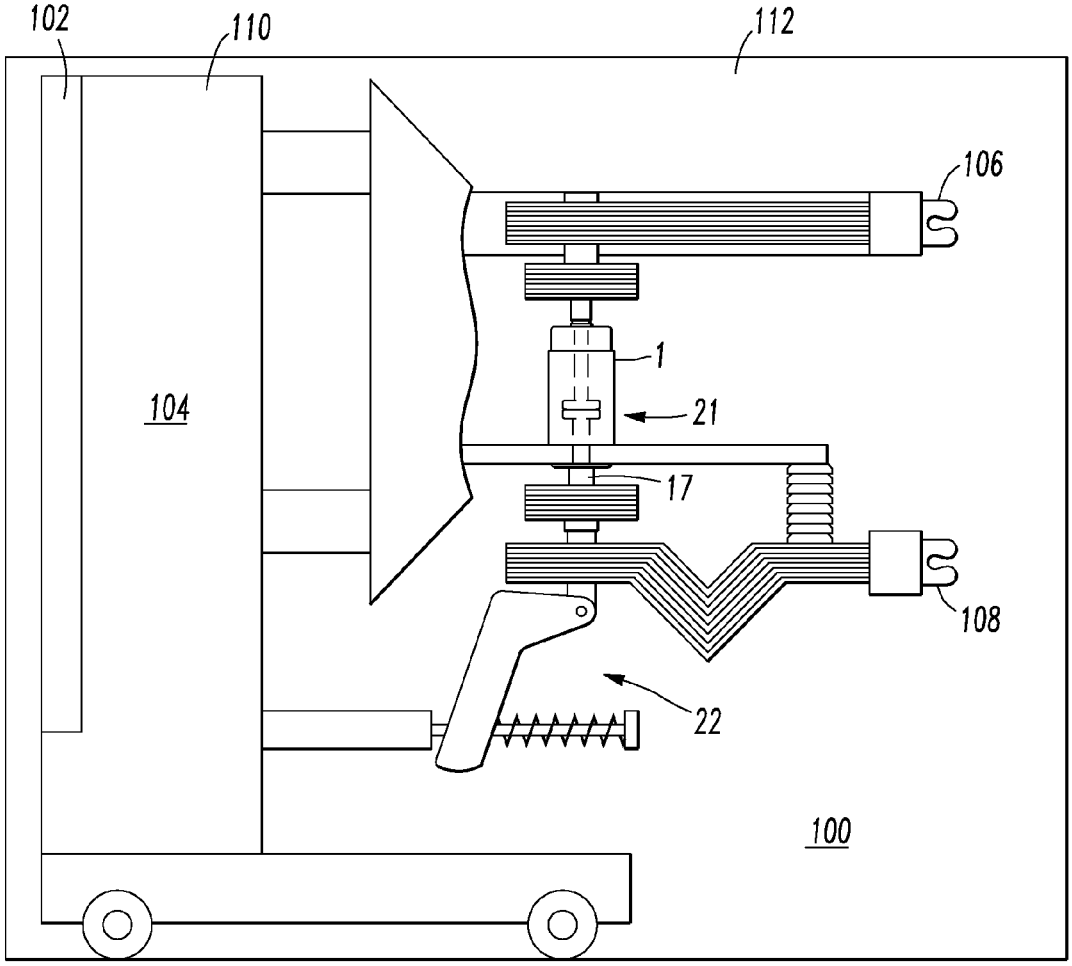
FIG. 2 is a vertical elevation view of a vacuum circuit breaker including the vacuum interrupter of FIG. 1.

As shown in FIG. 2, a vacuum circuit interrupter, such as the example vacuum circuit breaker 100, incorporates the vacuum interrupter 1 of FIG. 1. The circuit breaker 100 preferably includes a front panel 102, which has controls for manually operating the circuit breaker 100 and changing the state of the separable contacts 21 to either an open or closed condition, and a circuit breaker housing 104. The circuit breaker 100 has upper and lower (with respect to FIG. 2) terminals 106,108, and may have additional terminals not visible in FIG. 2, which can be connected to a line (not shown) and a load (not shown). The circuit breaker 100 has a low voltage portion 110 coupled to the front panel 102 and a high voltage portion 112 including the vacuum interrupter 1. The vacuum circuit breaker 100 also includes the operating mechanism 22 structured to axially reciprocate the moveable electrode 17 and move the moveable contact 15 (FIG. 1) into and out of contact with the fixed contact 11 (FIG. 1). Although one pole and one vacuum interrupter 1 are shown, it will be appreciated that the invention is applicable to vacuum circuit interrupters having any number of poles.

Figure 3:
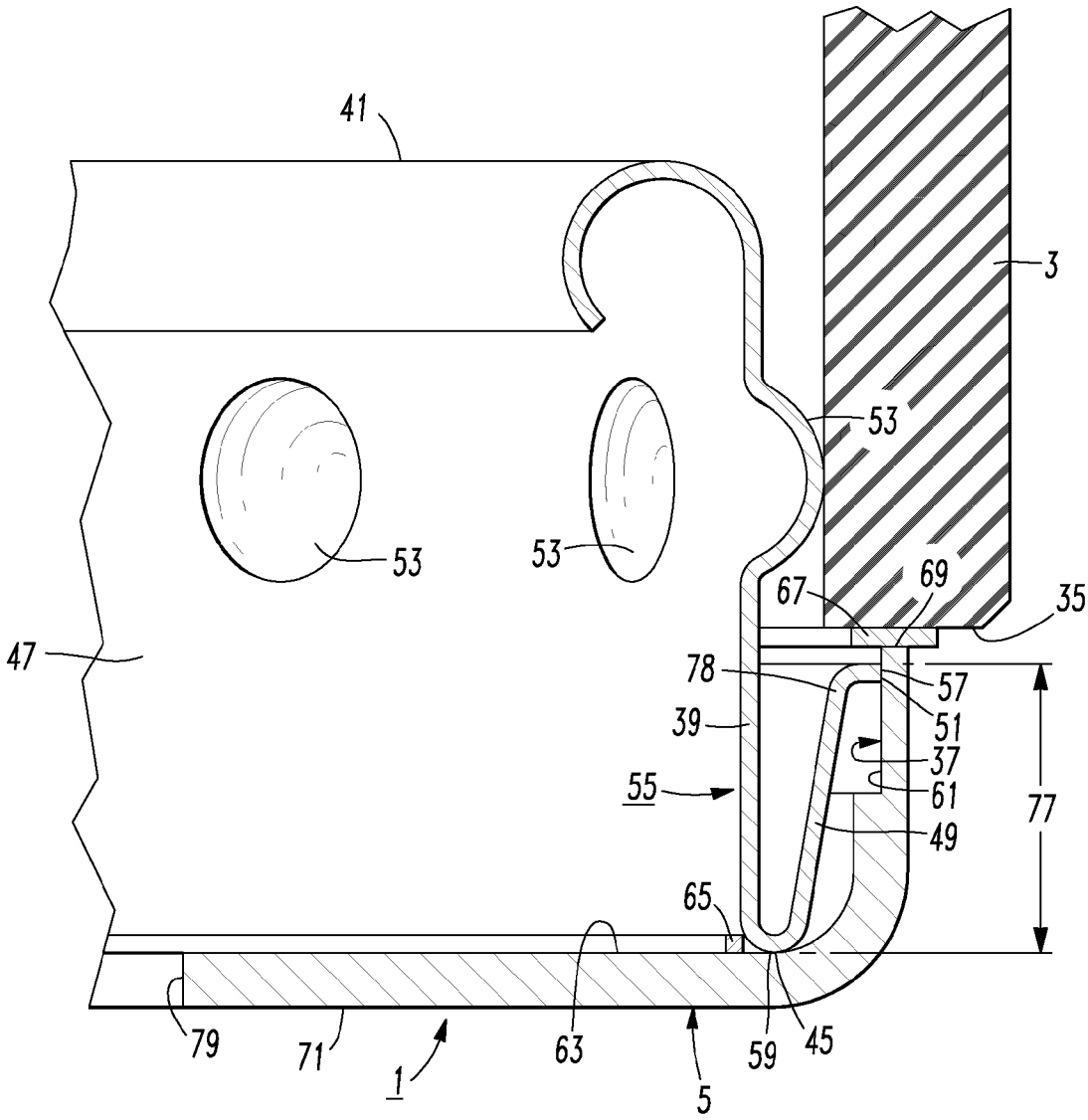
FIG. 3 is a sectional view of a portion of the vacuum interrupter of FIG. 1 showing the ceramic tube, end shield and the end member.

Referring to FIG. 3, an end portion of the vacuum interrupter 1 of FIG. 1 is shown including the ceramic tube 3, the end shield 39 and the end member 5. The intermediate portion 47 of the end shield 39 is a generally cylindrical portion 47 including a plurality of dimples 53 (as best shown in FIGS. 4 and 5) which engage the ceramic tube 3. Only the dimples 53 of the end shield 39 engage the ceramic tube 3.

The intermediate portion 47 and the flange portion 49 of the end shield 39 form a generally V-shaped structure 55 at the second open end 45 of the end shield 39. The generally V-shaped structure 55 includes a free circular edge 57 forming the edge 51 of the flange portion 49 and an end 59, which forms the second open end 45 of the end shield 39. The inside surface 37 of the second end member 5 includes a cylindrical surface 61 and an end surface 63 normal to the cylindrical surface 61. The free circular edge 57 of the generally V-shaped structure 55 engages the cylindrical surface 61. The end 59 of the generally V-shaped structure 55 engages the end surface 63. The generally V-shaped structure 55 is structured to self-align the end shield 39 within the second end member 5, while the dimples 53 perform a corresponding self-alignment function of the end shield 39 within the ceramic tube 3.

A braze ring 65 is disposed at the end surface 63 of the second end member 5 and proximate the end 59 of the generally V-shaped structure 55. The end 59 of the generally V-shaped structure 55 is brazed to the end surface 63 of the second end member 5. If the end 59 of the generally V-shaped structure 55 is erroneously not secured to (or if it becomes unsecured from) the end surface 63 of the second end member 5, then the end shield 39 is advantageously captured between the end surface 63 of the second end member 5 and the second open end 35 of the ceramic tube 3.

A braze washer 67 is disposed between the second open end 69 of the second end member 5 and the second open end 35 of the ceramic tube 3. The second open end 69 of the second end member 5 is brazed to the second open end 35 of the ceramic tube 3. Only the intermediate portion 47 of the end shield 39 engages the ceramic tube 3. In particular, the intermediate portion 47 of the end shield 39 is a generally cylindrical portion 47 including the dimples 53 which engage the ceramic tube 3.

Also referring to FIG. 6, the second end member 5 further includes a first end 71, the second open end 69 secured to the second open end 35 of the ceramic tube 3, and a cylindrical portion 73 disposed between the first end 71 and the second open end 69. The cylindrical portion 73 has a first height 75. The flange portion 49 of the end shield 39 has a second height 77 (FIG. 3), which is smaller than the first height 75, in order that the circular edge 51 of the flange portion 49 and the flange portion 49 are normally offset from where the second open end 69 of the second end member 5 is secured to the second open end 35 of the ceramic tube 3.

The end shield 39 includes a curved flange 78 that engages the inside surface 37 of the end member 5. The curved flange 78 provides a self-alignment function, which advantageously acts to align the end shield 39 within the end member 5. The end shield 39 also includes the dimples 53, which provide an additional alignment function. The end shield 39 only engages the ceramic tube 3 at the dimples 53.

A relatively narrow edge 69 of the end member 5 engages the bottom (with respect to FIG. 3) end 35 of the ceramic tube 3. The end member second open end 69 is brazed (e.g., without limitation, using the braze washer 67) to the ceramic tube second open end 35.

As shown in FIG. 2, the vacuum interrupter 1 is assembled into the vacuum circuit breaker 100 with the moveable electrode 17 (best shown in FIG. 1) facing down (with respect to FIG. 2). In contrast, FIG. 3 shows the end member 5 and the end shield 39 for the fixed electrode 13 facing down (with respect to FIG. 3).

Continuing to refer to FIG. 3, normally, the end shield 39 does not contact the bottom (with respect to FIG. 3) end 35 of the ceramic tube 3. Hence, if the end shield 39 on the fixed electrode end was erroneously loose (e.g., caused by a forgotten braze at the braze ring 65), then, in the position shown in FIG. 2, it would "fall". As best shown in FIG. 3, the flange portion 49 of the end shield 39 is structured to be slightly lower in height than the corresponding height of the end member 5, in order that it does not interfere with the end member/ceramic tube braze joint. In the position shown in FIG. 2, if the end shield 39 is erroneously loose, then the end shield 39 is captured against the bottom (with respect to FIG. 3) end 35 of the ceramic tube 3 and will not fall down. Otherwise, without the self-alignment flange 49 of the end shield 39, the end shield 39 could, in theory, touch the shield 25 (FIG. 1), thereby causing a short. Hence, this provides an error-proofing feature such that if the braze ring 65 is forgotten, then the end shield 39 will rattle (e.g., between the end member 5 and the ceramic tube 3), but the vacuum interrupter 1 will still function (e.g., interrupt properly) and will not cause a short.

The second end member 5 further includes a first end 71 having an opening 79 therein, the second open end 69, and the cylindrical portion 73 (FIG. 6) disposed between the first end 71 and the second open end 69. The cylindrical portion 73 forms the inside surface 61. The fixed electrode 13 extends through the opening 79 of the first end 71 of the second end member 5. The second open end 69 of the second end member 5 is secured to the second open end 35 of the ceramic tube 3.

The advantages of the disclosed vacuum interrupter 1 and end shield 39 include: (1) improved self-alignment as is provided by the flange portion 49 of the end shield 39; (2) a cost savings and an inventory reduction since the self-alignment flange portion 49 centers the end shield 39 within the end member 5, which eliminates an external self-aligning ceramic fixture (not shown), an internal braze ring (not shown) and an internal alignment flange (not shown); (3) elimination of an external self-aligning ceramic fixture and corresponding fixture weight speed up furnace run times and productivity; (4) elimination of an external self-aligning ceramic fixture, which can shield radiant heat from braze joints and result in a relatively poor joint and leaking vacuum interrupters, enable heat to directly penetrate the braze joints, thereby reducing leak-related scrap; (5) error-proofing, since if the end shield-to-end member braze is forgotten, the end shield flange 49 is trapped by the end 35 of the ceramic tube 3, as was discussed above; (6) reduced misalignment through improved self-alignment; and (7) improved productivity through improved self-alignment, since the vacuum interrupter 1 can be built relatively faster.

It will be appreciated that the disclosed end shield 39 can be employed with one or both of the end members (e.g., end members 5,7) of a vacuum interrupter.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A vacuum interrupter comprising:

a ceramic tube including a first open end and a second open end;

a first end member secured to the first open end of said ceramic tube;

a second end member including an inside surface, said second end member secured to the second open end of said ceramic tube, said first and second end members cooperating with said ceramic tube to form a vacuum envelope;

an end shield comprising:

a first end having an opening therein, a second open end, an intermediate portion disposed between the first end and the second open end of said end shield, and a flange portion disposed from the second open end of said end shield, said flange portion extending outwardly from the intermediate portion and generally back toward the first end, said flange portion ending at an edge engaging the inside surface of said second end member, said flange portion being offset from and not engaging said ceramic tube;

a fixed contact mounted on a fixed electrode extending through said second end member and extending through the opening of the first end of said end shield; and a moveable contact mounted on a moveable electrode extending through said first end member and axially reciprocating into and out of contact with said fixed contact.

2. The vacuum interrupter of claim 1 wherein the intermediate portion and the flange portion of said end shield form a generally V-shaped structure at the second open end of said end shield; wherein said generally V-shaped structure includes a free circular edge forming the edge of said flange portion and an end; wherein the inside surface of the second end member includes a cylindrical surface and an end surface normal to said cylindrical surface; wherein the free circular edge of said generally V-shaped structure engages the cylindrical surface; wherein the end of said generally V-shaped structure engages the end surface; and wherein said generally V-shaped structure is structured to self-align said end shield within said second end member.

3. The vacuum interrupter of claim 2 wherein a braze ring is disposed at the end surface of said second end member and proximate the end of said generally V-shaped structure; and wherein the end of said generally V-shaped structure is brazed to the end surface of said second end member.

4. The vacuum interrupter of claim 2 wherein the end of said generally V-shaped structure is not secured to the end surface of said second end member; and wherein said end shield is captured between the end surface of said second end member and the second open end of said ceramic tube.

5. The vacuum interrupter of claim 1 wherein said second end member further includes a first end having an opening therein, a second open end, and a cylindrical portion disposed between the first end of said second end member and the second open end of said second end member; wherein said cylindrical portion forms the inside surface; wherein the fixed electrode extends through the opening of the first end of said second end member; and wherein the second open end of said second end member is secured to the second open end of said ceramic tube.

6. The vacuum interrupter of claim 5 wherein a braze washer is disposed between the second open end of said second end member and the second open end of said ceramic tube; and wherein the second open end of said second end member is brazed to the second open end of said ceramic tube.

7. The vacuum interrupter of claim 1 wherein only the intermediate portion of said end shield engages said ceramic tube.

8. The vacuum interrupter of claim 7 wherein the intermediate portion of said end shield is a generally cylindrical portion including a plurality of dimples which engage said ceramic tube.

9. The vacuum interrupter of claim 8 wherein only the dimples of said end shield engage said ceramic tube.

10. The vacuum interrupter of claim 1 wherein said second end member further includes a first end, a second open end secured to the second open end of said ceramic tube, and a cylindrical portion disposed between the first end of said second end member and the second open end of said second end member; wherein said cylindrical portion has a first height; and wherein the flange portion of said end shield has a second height, which is smaller than said first height, in order that the edge of said flange portion is offset from and does not engage where the second open end of said second end member is secured to the second open end of said ceramic tube.

11. A vacuum envelope for a fixed contact mounted on a fixed electrode and a moveable contact mounted on a moveable electrode, said vacuum envelope comprising:

an insulative tube including a first open end and a second open end;

a first end member secured to the first open end of said insulative tube;

a second end member including an inside surface, said second end member secured to the second open end of said insulative tube; and an end shield comprising:

a first end having an opening therein, a second open end, an intermediate portion disposed between the first end and the second open end of said end shield, and a flange portion disposed from the second open end of said end shield, said flange portion extending outwardly from the intermediate portion and generally back toward the first end, said flange portion ending at an edge engaging the inside surface of the second end member, said flange portion being offset from and not engaging said insulative tube.

12. A method of self-aligning an end shield of a vacuum interrupter, said method comprising:

employing a ceramic tube including a first open end and a second open end;

securing a first end member to the first open end of said ceramic tube;

securing a second end member to the second open end of said ceramic tube;

forming a vacuum envelope with said first and second end members;

employing an end shield comprising a first end having an opening therein, a second open end, and an intermediate portion disposed between the first end and the second open end of said end shield;

disposing a flange portion from the second open end of said end shield;

extending said flange portion outwardly from the intermediate portion and generally back toward the first end;

ending said flange portion at an edge;

engaging said edge with the inside surface of said second end member; and offsetting said flange portion from and not engaging said ceramic tube.

13. The method of claim 12 further comprising:

forming a generally V-shaped structure at the second open end of said end shield with the intermediate portion and the flange portion of said end shield;

including with said generally V-shaped structure a free circular edge forming the edge of said flange portion and an end;

including with the inside surface of the second end member a cylindrical surface and an end surface normal to said cylindrical surface;

engaging the free circular edge of said generally V-shaped structure with the cylindrical surface;

engaging the end of said generally V-shaped structure with the end surface; and self-aligning said end shield within said second end member with said generally V-shaped structure.

14. The method of claim 12 further comprising:

disposing a braze ring at the end surface of said second end member and proximate the end of said generally V-shaped structure; and brazing the end of said generally V-shaped structure to the end surface of said second end member.

15. The method of claim 12 further comprising:

freeing the end of said generally V-shaped structure from the end surface of said second end member; and capturing said end shield between the end surface of said second end member and the second open end of said ceramic tube.

16. The method of claim 12 further comprising:

including with said second end member a first end having an opening therein, a second open end, and a cylindrical portion disposed between the first end of said second end member and the second open end of said second end member;

forming the inside surface with said cylindrical portion;

extending a fixed electrode through the opening of the first end of said second end member; and securing the second open end of said second end member to the second open end of said ceramic tube.

17. The method of claim 12 further comprising:

engaging said ceramic tube by said end shield with only the intermediate portion of said end shield.

18. The method of claim 12 further comprising:

including with said second end member a first end, a second open end secured to the second open end of said ceramic tube, and a cylindrical portion disposed between the first end of said second end member and the second open end of said second end member;

employing said cylindrical portion having a first height;

employing the flange portion of said end shield having a second height, which is smaller than said first height; and offsetting the edge of said flange portion from where the second open end of said second end member is secured to the second open end of said ceramic tube.

19. A vacuum circuit interrupter comprising:

a vacuum interrupter comprising:

a ceramic tube including a first open end and a second open end, a first end member secured to the first open end of said ceramic tube, a second end member including an inside surface, said second end member secured to the second open end of said ceramic tube, said first and second end members cooperating with said ceramic tube to form a vacuum envelope, an end shield comprising:

a first end having an opening therein, a second open end, an intermediate portion disposed between the first end and the second open end of said end shield, and a flange portion disposed from the second open end of said end shield, said flange portion extending outwardly from the intermediate portion and generally back toward the first end, said flange portion ending at an edge engaging the inside surface of said second end member, said flange portion being offset from and not engaging said ceramic tube, a fixed contact mounted on a fixed electrode extending through said second end member and extending through the opening of the first end of said end shield, and a moveable contact mounted on a moveable electrode extending through said first end member and axially reciprocating into and out of contact with said fixed contact; and an operating mechanism structured to axially reciprocate the moveable electrode and move said moveable contact into and out of contact with said fixed contact.

20. The vacuum circuit interrupter of claim 19 wherein the intermediate portion and the flange portion of said end shield form a generally V-shaped structure at the second open end of said end shield; wherein said generally V-shaped structure includes a free circular edge forming the edge of said flange portion and an end; wherein the inside surface of the second end member includes a cylindrical surface and an end surface normal to said cylindrical surface; wherein the free circular edge of said generally V-shaped structure engages the cylindrical surface; wherein the end of said generally V-shaped structure engages the end surface; and wherein said generally V-shaped structure is structured to self-align said end shield within said second end member.

21. The vacuum circuit interrupter of claim 20 wherein the end of said generally V-shaped structure is not secured to the end surface of said second end member; and wherein said end shield is captured between the end surface of said second end member and the second open end of said ceramic tube.

22. The vacuum circuit interrupter of claim 20 wherein the intermediate portion of said end shield is a generally cylindrical portion including a plurality of dimples which engage said ceramic tube; and wherein only the dimples of said end shield engage said ceramic tube.

* * * * *